US005839209A

United States Patent [19]

Healy et al.

[11] Patent Number: 5,839,209

[45] Date of Patent: Nov. 24, 1998

[54] SHOE SOLE HAVING AN IMPROVED CUSHION THEREIN AND METHOD OF MAKING SAME

[75] Inventors: John A. Healy, Madbury, N.H.; Eckhard Knoepke, Beverly, Mass.

[73] Assignee: Converse Inc., North Reading, Mass.

[21] Appl. No.: 827,350

[22] Filed: Mar. 26, 1997

[51] Int. Cl.[6] ..... A43B 13/18

[52] U.S. Cl. ..... 36/30 A; 36/27; 36/28; 36/35 R; 12/146 BR

[58] Field of Search ..... 36/27, 28, 30 A, 36/35 R, 38; 12/146 BR, 142 P

[56] References Cited

U.S. PATENT DOCUMENTS

| | | |
|---|---|---|
| 1,559,532 | 10/1925 | Smith . |
| 2,405,443 | 8/1946 | Mees . |
| 2,410,019 | 10/1946 | Davis . |
| 2,437,227 | 3/1948 | Hall . |
| 2,721,400 | 10/1955 | Israel . |
| 3,087,262 | 4/1963 | Russell . |
| 4,316,335 | 2/1982 | Giese et al. . |
| 4,342,157 | 8/1982 | Gilbert . |
| 4,364,188 | 12/1982 | Turner et al. . |
| 4,674,205 | 6/1987 | Anger . |
| 4,955,147 | 9/1990 | Bos . |
| 5,014,449 | 5/1991 | Richard et al. . |
| 5,079,856 | 1/1992 | Truelsen . |
| 5,201,125 | 4/1993 | Shorten . |
| 5,235,715 | 8/1993 | Donzis . |
| 5,282,288 | 2/1994 | Henson . |
| 5,311,674 | 5/1994 | Santiyanont et al. . |
| 5,367,791 | 11/1994 | Gross et al. . |
| 5,369,896 | 12/1994 | Frachey et al. . |
| 5,435,078 | 7/1995 | Pyle . |
| 5,435,959 | 7/1995 | Williamson et al. . |

FOREIGN PATENT DOCUMENTS

| | | |
|---|---|---|
| 165954 | 7/1947 | Austria . |

*Primary Examiner*—Ted Kavanaugh
*Attorney, Agent, or Firm*—Howell & Haferkamp, L.C.

[57] ABSTRACT

A method of making a shoe having a midsole, an upper, and an outsole. The method comprises providing a shoe midsole having a cavity in an underside thereof. The cavity is filled with a fluid which is curable to an elastomeric solid condition, and the fluid is allowed to cure to such solid condition. An outsole is secured to the underside of the midsole so that the outsole underlies the cavity, and an upper is secured to the midsole.

15 Claims, 2 Drawing Sheets

SHOE SOLE HAVING AN IMPROVED CUSHION THEREIN AND METHOD OF MAKING SAME

BACKGROUND OF THE INVENTION

This invention relates to shoes and methods for making shoes having cushions in their soles.

A typical athletic shoe includes an outsole, a midsole, and an upper. The midsole is generally made of a resilient foam material such as ethylene vinyl acetate (EVA) or polyurethane (PU). Some midsoles have recesses formed therein for containing resilient pads or fluid filled bladders.

A disadvantage of prior art pads and bladders is that they tend to shift within the recesses of the midsoles. Such shifting often changes the orientation of the pad or bladder which may reduce its effectiveness or comfort. The shifting may also cause the pad or bladder to rub against the midsole as the user walks or runs which may cause the shoe to squeak.

Another disadvantage of shoes having such pads and bladders is the cost of manufacturing such shoes. The pads and bladders must be made separate from the midsole and then placed in the midsole. Also, to prevent leakage of fluid from the shell of the bladder, the shell must be made sufficiently thick which tends to make it undesirably stiff and heavy, thereby increasing the stiffness and weight of the shoe.

SUMMARY OF THE INVENTION

Among the several objects of the present invention may be noted the provision of an improved shoe and of a method of making a shoe; the provision of such a shoe having an improved cushion in a cavity of the shoe's midsole; the provision of such a shoe configured to prevent shifting of the cushion within the midsole; the provision of such a shoe in which the cushion provides excellent cushioning, shock absorption, and energy return; the provision of a method of making a shoe in a cost effective manner; and the provision of such a method in which the cushion is formed in a cavity of the shoe.

Generally, a method of the present invention is for making a shoe having a midsole, an upper, and an outsole. The method comprises providing a shoe midsole having a cavity in an underside thereof, filling the cavity with a fluid which is curable to an elastomeric solid condition, allowing the fluid to cure to such solid condition, securing an outsole to the underside of the midsole so that the outsole underlies the cavity, and securing an upper to the midsole.

In another aspect of the present invention, a shoe comprises a sole having a cavity therein, an upper secured to the sole, an elastomeric cushion in the cavity of the sole, and at least one spring member embedded in the elastomeric cushion.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
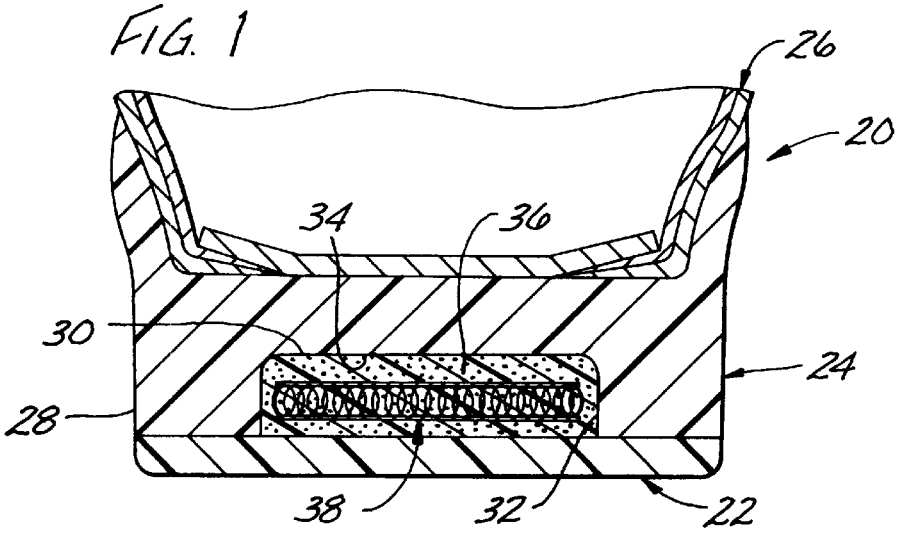
FIG. 1 is a fragmented vertical cross-sectional view of a shoe of the present invention, the cross-section being taken generally through the heel of the shoe.

Referring now to the drawings, and first more particularly to FIG. 1, a shoe of the present invention is indicated in its entirety by the reference numeral 20. The shoe 20 is preferably an athletic shoe (e.g., a running shoe or basketball shoe) and includes an outsole, generally indicated at 22, a midsole, generally indicated at 24, and an upper, generally indicated at 26. Preferably, the outsole 22 and midsole 24 are made of conventional outsole and midsole materials. In particular, the outsole 22 is preferably of a durable material, such as carbon rubber, and the midsole is preferably of a cushioning material, such as foam polyurethane or foam ethylene vinyl acetate.

Figure 2:
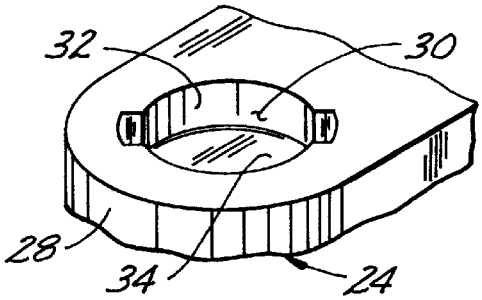
FIG. 2 is a fragmented, inverted, perspective view of a midsole used in the construction of the shoe of FIG. 1, the midsole having a cavity in its underside.
Figure 3:
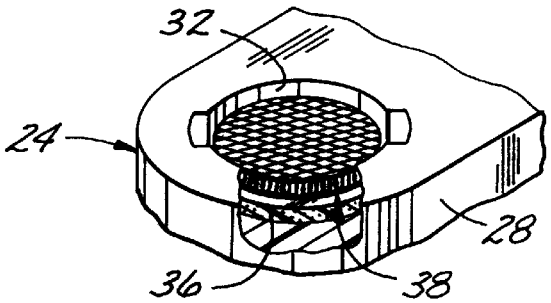
FIG. 3 is a fragmented, inverted, perspective view similar to that of FIG. 2, but with a mesh spring member in the cavity and with a fluid partially filling the cavity.
Figure 4:
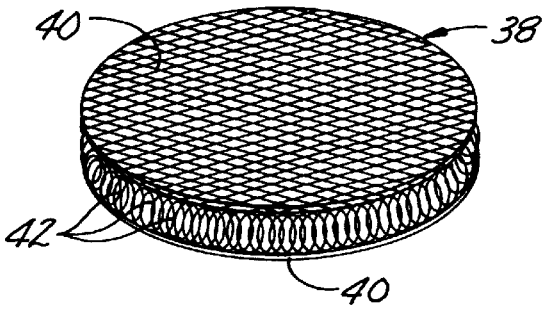
FIG. 4 is a perspective view of the mesh spring member of FIG. 3.
Figure 5:
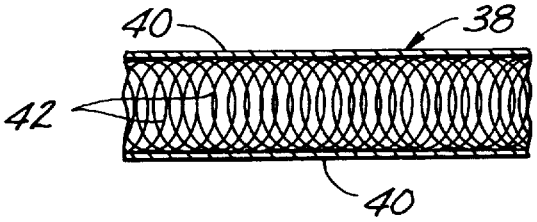
FIG. 5 is an enlarged cross-sectional view of the mesh spring member of FIG. 4.
Figure 6:
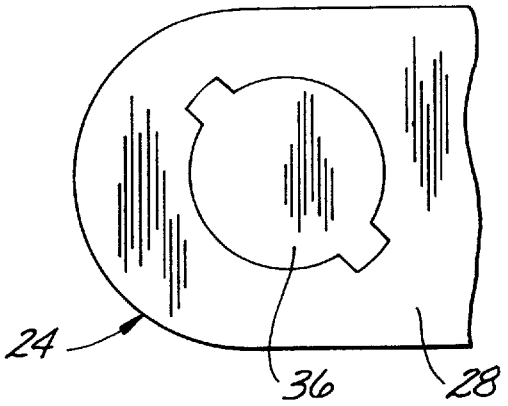
FIG. 6 is a fragmented bottom plan view of the midsole of FIGS. 2 and 3 with the cavity completely filled with the fluid.

As shown in FIGS. 1 and 2, the midsole includes a midsole body 28 and at least one cavity 30 formed therein. The cavity 30 is preferably-formed in the underside of the midsole body 28 and is preferably located in a particular region (e.g., the heel region and/or forefoot region) of the midsole where additional cushioning is desirable. The cavity 30 is defined by a cavity wall 32 and a cavity ceiling 34. The cavity wall 32 is preferably a closed curve and is spaced at all points from the periphery of the midsole body 28. In other words the cavity wall 32 does not merge with or intersect the periphery of the midsole body 28. Although the cavity 30 is shown as being generally circular in shape, it is to be understood that it could be of any desired shape without departing from the scope of this invention. Also, the cavity ceiling 34 is shown in FIG. 2 as being generally flat. However, it is to be understood that the cavity ceiling 34 could be of other shapes without departing from the scope of this invention.

The cavity 30 is filled with a polyurethane fluid substance 36 which is curable to an elastomeric solid condition, i.e., it becomes solid to a predetermined firmness and does not flow. The polyurethane substance 36 is preferably of two component fluids which are mixed together and then injected into the cavity 30 of the midsole body 28. Preferably, the two component fluids are selected such that the mixture cures within fifteen minutes into an elastomeric solid pad (also designated by reference number 36) having a durometer hardness different from that of the midsole body 28. One of the two component fluids is preferably a Polyether Polyol, and the other is a plasticizer with Isocyanate Terminated Prepolymers. These fluids are commercially available from Synair Corporation of Chattanooga, Tenn.

The two component fluids are injected into the cavity via a metered mixing and dispensing mechanism (not shown). Preferably, the dispensing mechanism is of the type commercially available from Ashby Cross of Tops Field, Mass. The meter mixing and dispensing equipment includes two separate tanks (not shown). One tank contains the liquid polyol and the other tank contains the liquid plasticizer. The liquids are drawn from their tanks in metered amounts, mixed via a mixing nozzle and then directly injected into the cavity of the midsole body 28. The combination of the two raw components when dispensed through the mixing nozzle has a viscosity comparable to that of motor oil (e.g., 800–1100 centipoise). Prior to curing therefore, the fluid substance 36 is a liquid, flows easily into the cavity 30, and can conform exactly to the three dimensional form of the cavity. Upon curing, the formed polyurethane pad 36 preferably has a durometer hardness in the range of 25–65 Shore 000 scale, and more preferably has a durometer hardness of approximately 45 Shore 000 scale. The exact material properties of the polyurethane pad 36 can be varied by changing the mixing ratio of the polyol and plasticizer. The midsole body 28 preferably has a durometer hardness in the range of 50–70 Asker C scale. The predominant property that is changed by varying the ratio is hardness. Although the pad 36 has been described as preferably being softer than the midsole body 28, it is to be understood that the formed pad could be harder than the midsole body without departing from the scope of this invention.

Preferably, the formed resilient pad 36 remains tacky even after it cures so that it bonds to the midsole body 28. This bond resists shifting of the pad 36 within the shoe 20. Thus, the tackiness of the pad 36 maintains effectiveness of the pad 36 and comfort of the shoe 20 by preventing a change in orientation of the pad, and also prevents shoe squeak.

Referring now to FIGS. 3–6, at least one mesh spring member, generally indicated at 38, is placed in the cavity 30 during injection of the fluid substance 36 so that the mesh spring member is within the formed pad 36. The mesh spring member 38 is configured to increase spring, stability, and rebound properties of the pad 36. Preferably, the spring member 38 is lighter than the pad material so that insertion of the spring member into the cavity reduces the amount of the pad material needed to completely fill the cavity and thereby reduces the overall weight of the shoe. The spring member 38 preferably comprises a polyester sandwich mesh having first and second spaced-apart, generally parallel mesh sheets 40, and a plurality of resilient connecting fibers 42 extending between the mesh sheets. The fibers 42 are configured to resiliently urge the mesh sheets 40 into their spaced-apart orientation. A suitable polyester sandwich mesh is commercially available from Tsuen Lin Industrial Co., Ltd., of Shy Hwu Hsiang, Yunlin Hsien, Taiwan, model number TL333-21C or TL333-17C.

To make the shoe 20, the midsole body 28 is formed with the cavity 30 in its underside. Some of the fluid substance 36 is injected into the cavity 30 to partially fill (e.g., half fill) the cavity (see FIG. 3). The mesh spring member 38 is then placed in the cavity and more fluid substance 36 is injected into the cavity 30 to fully fill the cavity. Preferably, the fluid substance 36 seeps between the connecting fibers 42 of the mesh spring member 38 to fill all voids therebetween. The fluid substance 36 is then allowed to cure to an elastomeric solid condition. After curing, the outsole 22 is secured to the underside of the midsole body 28 to completely cover the cavity 30, and the upper 26 is secured to an upper region of the midsole body. Thus, a shoe is formed having excellent cushioning characteristics, and avoiding the disadvantages of prior art shoes.

Figure 7:
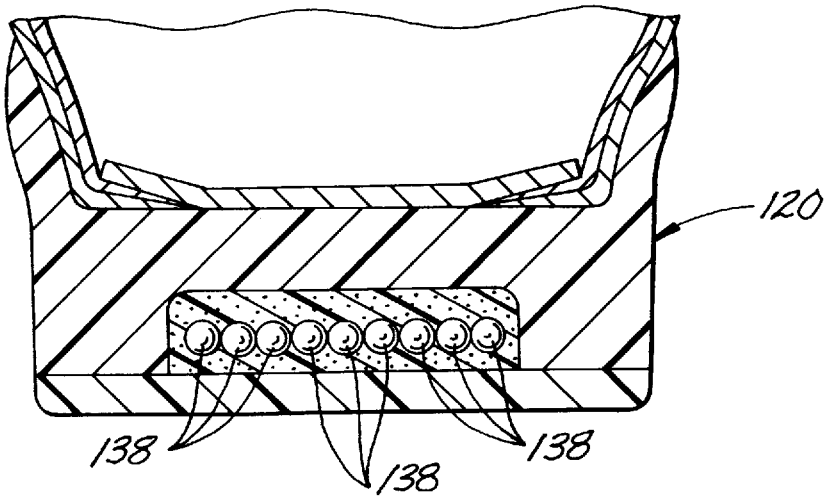
FIG. 7 is a fragmented vertical cross-sectional view of another embodiment of a shoe of the present invention, the shoe being similar to the shoe of FIG. 1 but having a plurality of hollow polymeric spherical members instead of the mesh spring member.

Referring now to FIG. 7, another embodiment of a shoe of the present invention is indicated in its entirety by the reference numeral 120. The shoe 120 is identical to the shoe 20 except the mesh spring member 38 is replaced with a plurality of hollow, gas-filled, polymeric, spherical members 138. The polymeric members 138 may be of any suitable polymeric material such as high-density polyurethane or low-density polyurethane. The polymeric members 138 are inserted into the cavity before the fluid cures to the elastomeric solid condition. Preferably, the polymeric members 138 are lightweight to reduce the weight of the shoe without reducing resiliency or support.

Although the polymeric members 138 have been described as being spherical, it is to be understood that they could be of other shapes without departing from the scope of this invention. Also, other types of spring members (e.g., a coil spring) could be used instead of the mesh spring member or polymeric members.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of making a shoe having a midsole, an upper, and an outsole, the method comprising:

providing a shoe midsole having a cavity in an underside thereof;

filling the cavity with a fluid which is curable to an elastomeric solid condition;

allowing the fluid to cure to said elastomeric solid condition;

securing an outsole to the underside of the midsole so that the outsole underlies the cavity;

securing an upper to the midsole.

2. A method as set forth in claim 1 wherein the step of securing the upper to the midsole occurs after the step of filling the cavity with the fluid.

3. A method as set forth in claim 1 wherein the step of securing the outsole to the underside of the midsole occurs after the step of filling the cavity with the fluid.

4. A method as set forth in claim 1 further comprising the step of inserting at least one spring member into the cavity before allowing the fluid to cure to its solid condition.

5. A method as set forth in claim 1 wherein the step of filling the cavity with a fluid which is curable to an elastomeric solid condition comprises filling the cavity with a fluid which, after it cures to an elastomeric solid condition, has a tacky outer surface.

6. A method as set forth in claim 5 wherein said at least one spring member comprises a mesh material, said mesh material being inserted into the cavity before completion of the filling step.

7. A method as set forth in claim 5 wherein said at least one spring member comprises at least one gas-filled polymeric member, said at least one gas-filled polymeric member being inserted into the cavity before the fluid cures to its solid state.

8. A method as set forth in claim 1 wherein the step of filling the cavity with a fluid comprises completely filling the cavity with a fluid which is curable to an elastomeric solid condition.

9. A method of making a shoe having a sole and an upper, the method comprising:

providing a shoe sole having a cavity therein;

inserting at least one spring member into the cavity;

filling the cavity with a fluid which is curable to an elastomeric solid condition;

allowing the fluid to cure to its said condition; and securing an upper to the sole.

10. A method as set forth in claim 9 wherein the step of securing the upper to the sole occurs after the step of filling the cavity with the fluid.

11. A method as set forth in claim 9 further comprising the step of inserting at least one spring member into the cavity before allowing the fluid to cure to its solid condition.

12. A method as set forth in claim 9 wherein the step of filling the cavity with a fluid which is curable to an elastomeric solid condition comprises filling the cavity with a fluid which, after it cures to an elastomeric solid condition, has a tacky outer surface.

13. A method as set forth in claim 12 wherein said at least one spring member comprises a mesh material, said mesh material being inserted into the cavity before completion of the filling step.

14. A method as set forth in claim 12 wherein said at least one spring member comprises at least one gas-filled polymeric member, said at least one gas-filled polymeric member being inserted into the cavity before the fluid cures to said solid state.

15. A method as set forth in claim 14 wherein said at least one gas-filled polymeric member comprises a plurality of hollow polymeric spherical members, said spherical members being inserted into the cavity before the fluid cures to said solid state.

* * * * *